US012667181B2

(12) United States Patent
Pedroza

(10) Patent No.: US 12,667,181 B2
(45) Date of Patent: Jun. 30, 2026

(54) EYELASH PROTECTOR MAKEUP ACCESSORY

(71) Applicant: Selena Pedroza, Aurora, IL (US)

(72) Inventor: Selena Pedroza, Aurora, IL (US)

( * ) Notice: Subject to any disclaimer, the term of this patent is extended or adjusted under 35 U.S.C. 154(b) by 139 days.

(21) Appl. No.: 18/614,585

(22) Filed: Mar. 22, 2024

(65) Prior Publication Data

US 2024/0315424 A1 Sep. 26, 2024

Related U.S. Application Data

(60) Provisional application No. 63/454,035, filed on Mar. 22, 2023.

(51) Int. Cl.
*A45D 44/00* (2006.01)

(52) U.S. Cl.
CPC ..... *A45D 44/00* (2013.01)

(58) Field of Classification Search
CPC ..... A45D 40/30; A45D 44/00; A45D 44/002; A45D 44/12; A45D 44/22; A45D 27/42; A45D 29/18
USPC ..... D28/7
See application file for complete search history.

(56) References Cited

U.S. PATENT DOCUMENTS 1,873,928 A * 8/1932 Bohner ..... A45D 40/30 132/216
5,052,417 A * 10/1991 Cordova ..... A45D 40/00 132/319
5,890,499 A * 4/1999 Fuentes ..... A45D 40/30 132/285
5,957,142 A * 9/1999 Karafilis ..... A45D 40/30 132/285
6,640,814 B1 * 11/2003 Burke ..... A45D 2/48 132/319
D536,129 S * 1/2007 Davis ..... D28/7
D576,352 S * 9/2008 Brestoni ..... D28/7
8,684,013 B2 * 4/2014 Haman ..... A45D 44/12 132/319
2002/0124865 A1 * 9/2002 Davis ..... A45D 40/30 132/319
2006/0225761 A1 * 10/2006 Secosky ..... A45D 40/265 132/319
2009/0194126 A1 * 8/2009 Cassese ..... A45D 40/30 132/319
2017/0049216 A1 * 2/2017 Rhoades ..... A45D 40/30
(Continued)

*Primary Examiner* — Rachel R Steitz
*Assistant Examiner* — Karim Asqiriba

(57) ABSTRACT

An eyelash protector makeup accessory is provided which utilizes a shield portion having a first side surface opposite a second side surface and a third side surface opposite a fourth side surface. A first coupling structure is disposed adjacent a first peripheral edge of the first side surface. The first side surface comprises a first convex shape having a first radius of curvature value. The third side surface utilizes a first concave shape having a second radius of curvature value. The accessory further utilizes an elongate handle portion having an elongate shaft. The elongate shaft utilizes a gripping element disposed at a proximal end thereof and a second coupling structure disposed at a distal end thereof. The second coupling structure is shaped in a complimentary manner relative the first coupling structure and the second coupling structure removably engages the first coupling structure.

18 Claims, 9 Drawing Sheets

(56) References Cited

U.S. PATENT DOCUMENTS

| | | | | |
|---|---|---|---|---|
| 2020/0337433 | A1* | 10/2020 | Chung | A45D 34/04 |
| 2022/0256995 | A1* | 8/2022 | Foley | A45D 40/30 |

* cited by examiner

100a

300b

400

EYELASH PROTECTOR MAKEUP ACCESSORY

CROSS-REFERENCE TO RELATED APPLICATIONS

This application claims priority to U.S. Provisional Patent Application Ser. No. 63/454,035, entitled "Eyelash Protector Makeup Accessory," filed Mar. 22, 2023. The contents of this application are hereby incorporated by reference in their entirety.

BACKGROUND OF THE INVENTION

The field of cosmetics and beauty accessories is continually evolving, with significant advancements aimed at enhancing the application process and the durability of makeup products. In the eyeshadow makeup industry, precision and cleanliness are paramount. Users seek products that not only facilitate the application of makeup but also ensure that the process is as clean and efficient as possible. Despite the vast array of tools available, there remains a need for devices that can protect sensitive areas, such as eyelashes, from makeup residue during the application of surrounding cosmetics.

One of the primary challenges in the application of eyeshadow, foundation, concealer, and similar products is the prevention of makeup contamination. Particularly, the inadvertent application of these products to eyelashes, including fake eyelashes, can be both frustrating and time-consuming to remedy. This issue is compounded by the delicate nature of eyelashes and the difficulty in removing excess makeup without damaging them or the surrounding eye area.

Chronic contamination of the eye with eyeshadow makeup can lead to several physical harms. Frequent exposure to makeup particles can irritate the eye, leading to discomfort, redness, and in severe cases, infections such as conjunctivitis. Furthermore, the abrasive process of removing stubborn makeup can cause physical harm to the delicate skin around the eyes, potentially leading to premature wrinkling or sagging. Additionally, the eyelashes themselves can suffer-excessive makeup buildup can lead to lash breakage or loss, undermining their natural protective function against dust and debris. These adverse effects underscore the need for a solution that mitigates the risk of eyeshadow makeup contaminating the eye, ensuring a safer and more hygienic makeup application process.

The current market offers a variety of eyeshadow makeup accessories designed to assist in the application process. These range from simple applicators to more complex tools aimed at providing precision and ease of use. However, these types of devices fall short when it comes to protecting the eyelashes and eyes from contamination. For instance, they often lack the necessary features to shield the eyelashes effectively or are cumbersome to use, thereby not fully addressing the user's needs.

The existing problems and needs within the eyeshadow makeup accessory market highlight the demand for an innovative solution that can offer both protection and convenience. Users seek a tool that not only aids in the precise application of makeup but also ensures that their eyes and eyelashes, both natural and artificial, are safeguarded against unwanted makeup contact. The inefficiencies in current products underscore the necessity for a device that is both effective in its primary function and enhances the overall makeup application experience.

Therefore, it would be advantageous to provide an eyelash protector makeup accessory that responds to these market needs by providing a novel tool designed specifically to protect eyes, eyelashes and extensions from cross-contamination with other cosmetic products. It would be further advantageous to utilize an elongated handle attached to a curved shield in order to offer users a seamless makeup application process. By preventing eyeshadow pigmentation and similar cosmetics from coming into contact with the eyes or eyelashes, such a tool would address the significant issue of contamination. Furthermore, the design of such a tool not only keeps false eyelashes cleaner and thereby extends their wearability but also saves users considerable time and effort when applying various cosmetics to the eyes and face. Through such a unique combination of functionality and design, the eyelash protector makeup accessory would be advantageous in proposing a practical solution to the longstanding challenges faced by individuals in the cosmetic industry.

DETAILED DESCRIPTION OF THE INVENTION

Before describing the present invention in detail, it is to be understood that the invention is not limited to any one of the particular embodiments, which of course may vary. It is also to be understood that the terminology used herein is for the purpose of describing particular embodiments only, and therefore is not necessarily intended to be limiting. As used in this specification and the appended claims, terms in the singular and the singular forms "a," "an," and "the" include plural referents unless the context clearly dictates otherwise. Thus, for example, reference to "an eyelash protector makeup accessory" or any of its constituent parts also includes a plurality of eyelash protector makeup accessories or any of its constituent parts and the like.

Figure 1A:
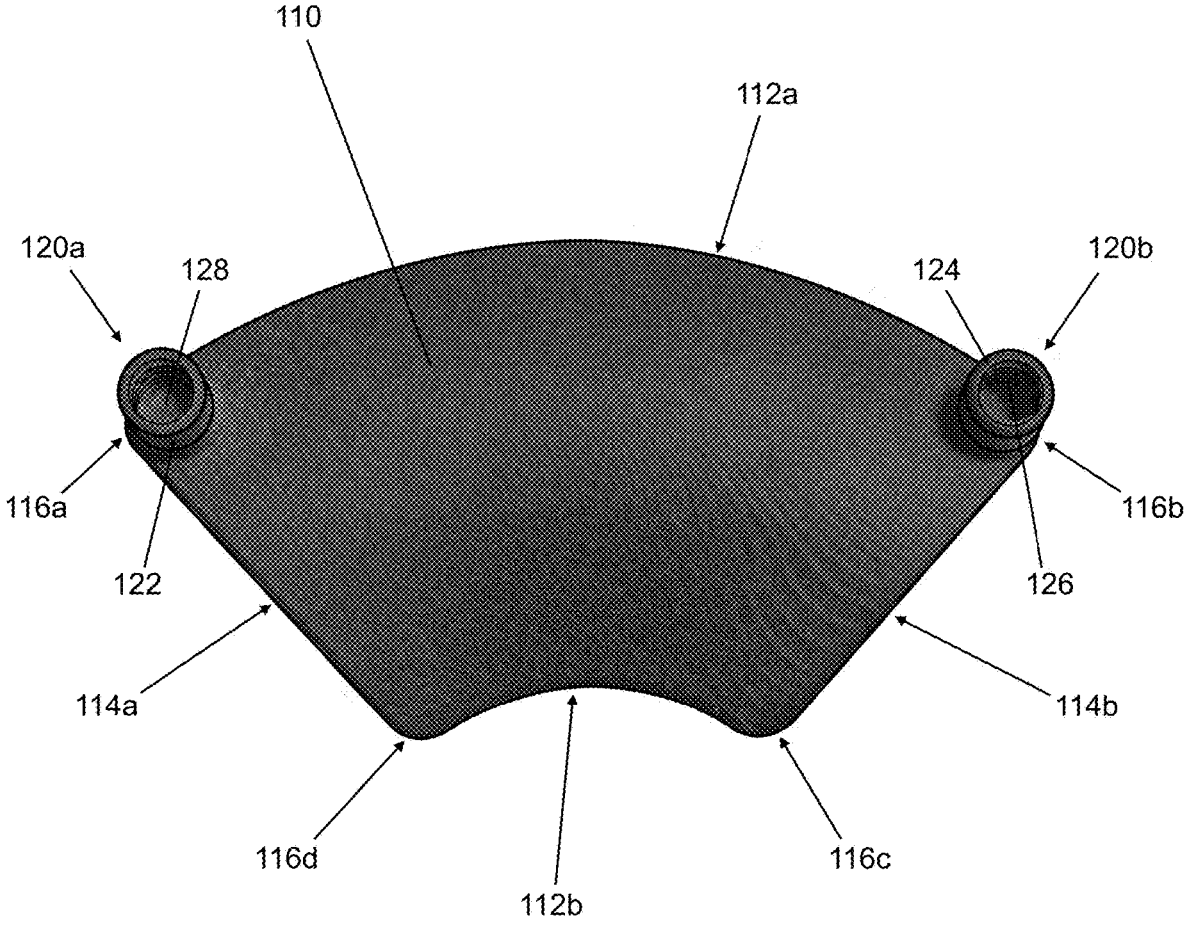
FIG. 1A illustrates a bottom overhead view of a shield portion of an eyelash protector makeup accessory with a pair of opposing coupling structures extending out from a bottom side surface thereof in accordance with some embodiments of the present invention.

Exemplary embodiments of the present invention are illustrated in the accompanying figures. As shown in FIG. 1A, a bottom overhead view of a shield portion 100*a* of an eyelash protector makeup accessory with a pair of opposing coupling structures 120*a*, 120*b* extending out from a bottom side surface 110 thereof is provided. The shield portion 100*a* may comprise front and rear side surfaces 112*a*, 112*b* adjacent the bottom side surface 110. The front side surface 112*a* may comprise a generally convex shape in that the surface 112*a* bows outward with a positive radius of curvature. Conversely, the rear side surface 112*b* may comprise a generally concave shape in that the surface 112*b* bows inward with a negative radius of curvature. Further, the rear side surface 112*b* may have a smaller magnitude radius of curvature value relative the front side surface 112*a*.

The shield portion 100*a* may further comprise left and right side surfaces 114*a*, 114*b* coupled between the front and rear side surfaces 112*a*, 112*b*. Each of the left and right side surfaces 114*a*, 114*b* may be within +/−15 degrees of being orthogonal to the tangent line of the front side surface 112*a*. Similarly, each of the left and right side surfaces 114*a*, 114*b* may be within +/−15 degrees of being orthogonal to the tangent line of the rear side surface 112*b*. Preferably, the left and right side surfaces 114*a*, 114*b* may be within +/−10 degrees of being orthogonal to the tangent line of the front and rear side surfaces 112*a*, 112*b*.

Each of the bottom side surface 110, the front and rear side surfaces 112*a*, 112*b*, and the left and right side surfaces 114*a*, 114*b* (along with a top side surface opposite that of the bottom side surface 110 not shown in FIG. 1A) may be contemplated as being sets of side surface pairs respectively disposed opposite one another as shown in FIG. 1A. Further, each of the bottom side surface 110, the front and rear side surfaces 112*a*, 112*b*, and the left and right side surfaces 114*a*, 114*b* (along with a top side surface opposite that of the bottom side surface 110 not shown in FIG. 1A) may comprise a radius of curvature value that may be the same or different from one another and may be arranged in the same or different cross-sectional planes.

Such a range would be advantageous in providing the user with an ergonomic fit for the eyelash protector makeup accessory. This advantageous angle range provides a design that closely aligns with the natural curvature of the human eyelid, ensuring a more comfortable fit for users. The closer alignment minimizes gaps between the eyelid and the protector, reducing the risk of makeup smudging or entering the eye area. An angle orientation outside of this range may disadvantageous provide gaps between the user's eyelid and the shield portion 100*a*.

Further, such a range provides an efficient material use during the manufacturing process which reduces unit cost. By optimizing the shape to closely match the eyelid's contour, the design minimizes the use of excess material. This not only reduces the weight and bulk of the accessory, making it more comfortable and less obtrusive, but also cuts down on manufacturing costs through more efficient material use. An angle orientation outside of this range may disadvantageously provide a shield portion 100*a* that utilizes unnecessary material and thereby reduces the user-friendliness of the accessory and increases its production cost.

Additionally, the precise orientation of the left and right side surfaces facilitates a more streamlined and aesthetically pleasing design, which is likely to be more appealing to consumers. A design that closely mimics the natural contours of the eye not only functions better but also looks more integrated when in use, potentially improving the user's experience and satisfaction with the product. This careful balance between functional design and aesthetic appeal can play a crucial role in differentiating the eyelash protector makeup accessory in a competitive market.

Between the front, rear, left and right side surfaces 112*a*, 112*b*, 114*a*, 114*b* are disposed corner side surfaces 116*a*-116*d* respectively. Each of the corner side surfaces 116*a*-116*d* may subsume an angle within +/−15 degrees of 90 degrees given the angular orientation range of the left and right side surfaces 114*a*, 114*b* relative the tangent lines of the convex front side surface 112*a* and the concave rear side surface 112*b*.

Further, the shield portion 100*a* may utilize planar straight edges for each of the front, rear, left and right side surfaces 112*a*, 112*b*, 114*a*, 114*b* and the corner side surfaces 116*a*-116*d* such that they each form a fine point edge with the bottom side surface 110. Alternatively, the shield portion 100*a* may utilize rounded shapes for the front, rear, left and right side surfaces 112*a*, 112*b*, 114*a*, 114*b* and the corner side surfaces 116*a*-116*d* such that all of these side surfaces do not form a fine point edge with the bottom side surface 110 but rather form a tapered convex rounded edge with the bottom side surface 110. Such a fine point edge or tapered convex rounded edge are described with respect to a first cross-sectional plane projecting out of the page in FIG. 1A. However, there may be different considerations when considering the shape of the side surfaces in a second cross-sectional plane parallel with the page in FIG. 1A and orthogonal to the first cross-sectional plane.

Specifically, the inclusion of rounded shapes, with respect to the second cross-sectional plane, for at least the corner side surfaces 116*a*-116*d* in the design of the shield portion of the eyelash protector makeup accessory may serve multiple functional and safety purposes, particularly given its use adjacent to the sensitive area of a user's eye. Rounded corners, as opposed to fine point shaped corners, significantly reduce the risk of accidental injury or discomfort during use. The eye area is extremely delicate, and even a minor slip during makeup application could lead to scratches or punctures if the corners were not rounded. The decision to implement rounded corners takes into account the safety and comfort of the user, ensuring a gentler contact point with the skin around the eye.

Furthermore, use of rounded corner shapes for the corner side surfaces 116*a*-116*d* can improve the overall user experience by providing a smoother application process. They allow the shield to glide more easily over the skin without catching or dragging, which can be particularly beneficial when working around the contours of the eye. This can lead to a more comfortable and controlled makeup application process, minimizing disruptions and enhancing precision.

Additionally, the use of rounded corner side surfaces can enhance the durability of the device. Sharp corners are more prone to chipping or breaking when dropped, which can compromise the safety and integrity of the makeup accessory. Rounded corners, however, can better distribute impact forces, reducing the likelihood of damage from accidental falls or mishandling. This design consideration not only improves the product's longevity but also maintains its safety features over time. Additionally, each of these advantages may also apply to the logic of utilizing tapered convex rounded edges in the first cross-sectional plane.

The shield portion 100*a* may further comprise the pair of opposing coupling structures 120*a*, 120*b* extending out from the bottom side surface 110. Each of the coupling structures 120*a*, 120*b* may comprise a cylindrical outer body 122 that terminates in a terminal outer ridge 124 which defines an opening to an interior cavity 128 that is bounded by the bottom side surface 110 and a set of threads 126 that are disposed on an interior of the cylindrical outer body 122. The cavity 128 is shaped to accept an appropriately sized coupling structure of an elongate handle portion of FIG. 1B via a complimentary set of threads that engage the threads 126 of the coupling structures 120*a*, 120*b*.

Figure 1B:
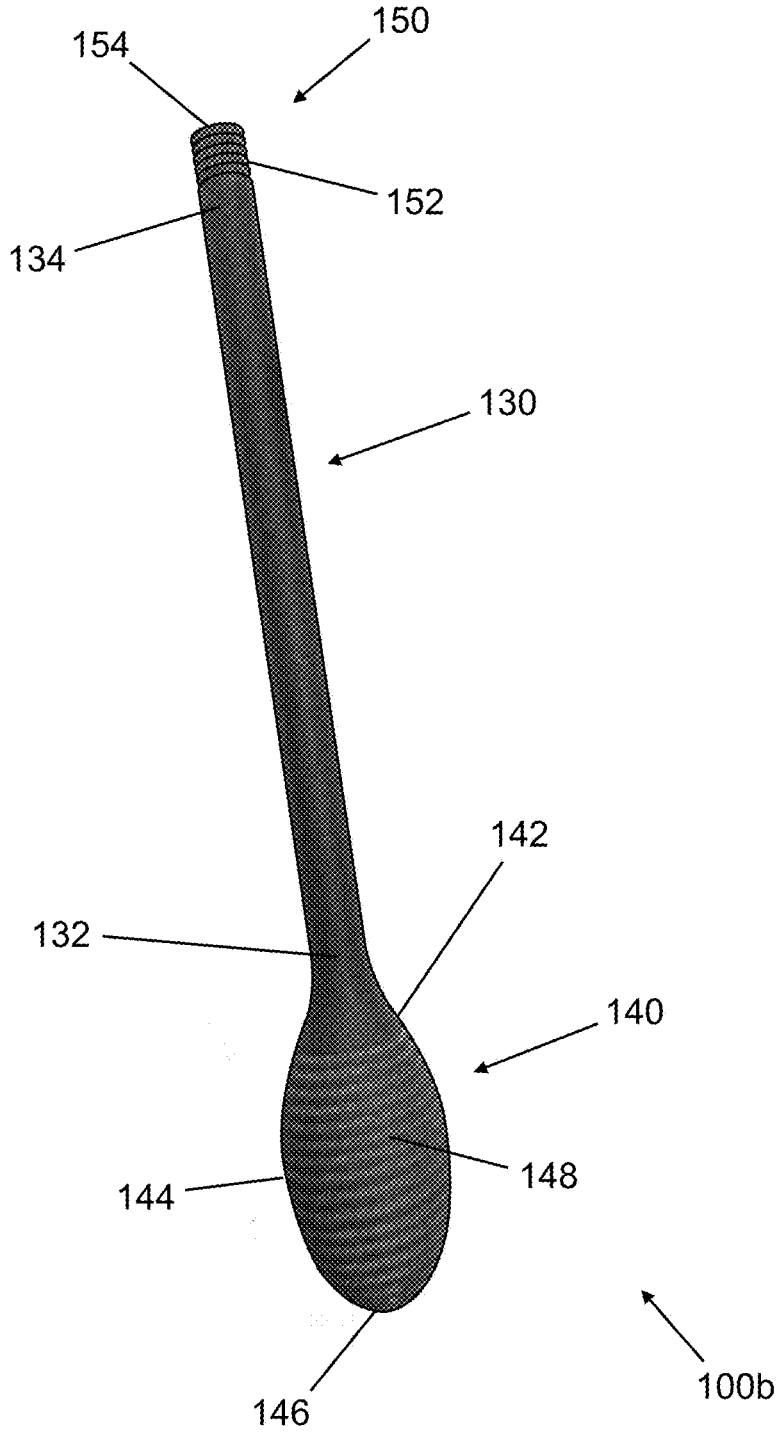
FIG. 1B illustrates a side perspective view of an elongate handle portion of an eyelash protector makeup accessory with a curved gripping element and coupling structure disposed at opposing ends thereof in accordance with some embodiments of the present invention.

As shown in FIG. 1B, a side perspective view of an elongate handle portion 100*b* of an eyelash protector makeup accessory with a curved gripping element 140 and coupling structure 150 disposed at opposing ends of an elongate shaft 130 is provided. The elongate shaft 130 may comprise a proximal end 132 that may be coupled to the curved gripping element 140 and a distal end 134 that may be coupled to the coupling structure 150.

The elongate shaft 130 may comprise a generally symmetric cylindrical rod shape that extends between the proximal and distal ends 132, 134. However, the proximal end 132 may comprise a slight outward taper in order to accommodate the much larger form factor of the curved gripping element 140 as shown in FIG. 1B. The distal end 134 may comprise the same general shape as the remainder of the body of the elongate shaft 130 but may taper inwards to accommodate the smaller form factor of the coupling structure 150.

The curved gripping element 140 may comprise a distal portion 142 that is coupled to the proximal end 132 of the elongate shaft 130. The curved gripping element 140 may taper outward from the distal portion 142 to the waist portion 144 which defines the largest cross-sectional dimension of the element 140 and further marks the point at which the element 140 begins tapering back inward toward the proximal portion 146 which marks the terminal end of the element 140 and the elongate handle portion 100*b* as a whole.

Within the waist portion 144 and between the distal and proximal portions 142, 146 may be disposed a plurality of gripping structures 148 which may be formed as a plurality of horizontal ridges separated successively by a respective plurality of troughs in order to form a periodic gripping structure 148 that allows the user to more easily grasp the elongate handle portion 100*b* and thereby more easily maneuver the eyelash protector makeup accessory more effectively. Such a design optimizes the user-friendly functionality of the accessory while also advantageously reducing the likelihood of user injury caused by a lost grip.

The coupling structure 150 may comprise a set of threads 152 that begin just after the termination of the proximal end 134 of the elongate shaft 130. The set of threads 152 is structured to be complementary to the set of threads 126 of the shield portion 100*a*. Similarly, the terminal end 154 of the coupling structure 150 is structured to be complimentary to the interior cavity 128 of the coupling structures 120*a*, 120*b* of the shield portion 100*a*. Thereby, the user may advantageously engage the coupling structure 150 with either of the coupling structures 120*a*, 120*b* in a robust manner so that the user may choose which side to attach the elongate handle portion 100*b* to the shield portion 100*a*.

Providing a pair of opposing coupling structures 120*a*, 120*b* on either end of the shield portion 100*a*, designed to engage with the coupling structure 150 of the elongate handle portion 100*b*, offers significant advantages by enhancing the versatility and user-friendliness of the eyelash protector makeup accessory. This design choice accommodates the natural variance in users' handedness, allowing both left-handed and right-handed individuals to use the device comfortably and effectively. By enabling the handle to be attached to either side of the shield, the design ensures that users can maintain a natural wrist position, reducing strain and improving control during makeup application. Furthermore, this flexibility facilitates the application of makeup to both the left and right eye with ease, allowing users to switch hands as needed without compromising on precision or efficiency. Such adaptability not only improves the overall usability of the device but also ensures that it caters to a wider audience, accommodating individual preferences and application techniques.

Figure 1C:
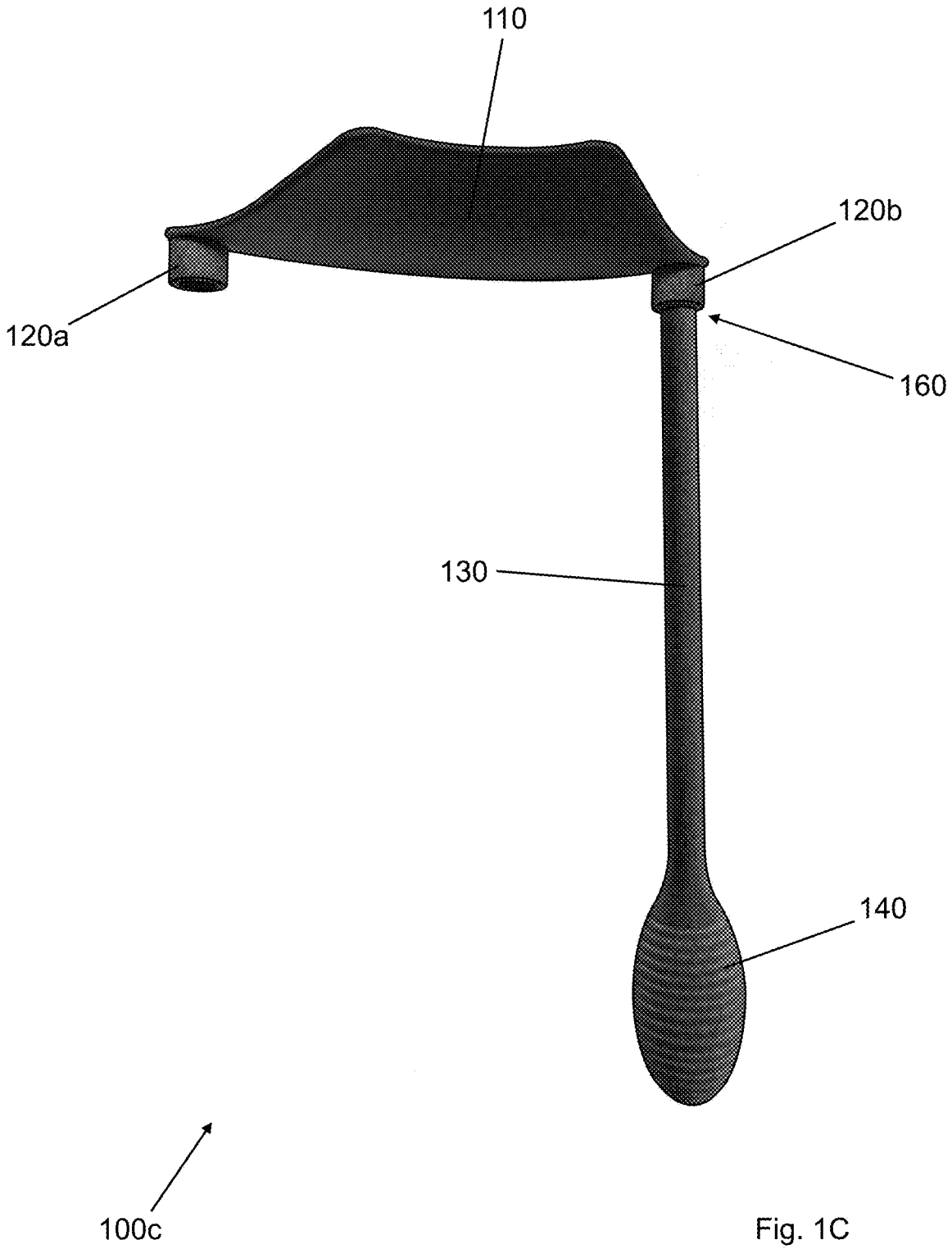
FIG. 1C illustrates a side elevational view of a shield portion coupled to an elongate handle portion of an eyelash protector makeup accessory via complementary coupling structures of each being secured together in accordance with some embodiments of the present invention.

As shown in FIG. 1C, a side elevational view of a shield portion coupled to an elongate handle portion of an eyelash protector makeup accessory 100*c* via complementary coupling structures of each being secured together is provided. The eyelash protector makeup accessory 100*c* may comprise the coupling structure 150 of the elongate handle portion 100*b* of FIG. 1B being coupled to one of the coupling structures 120*a*, 120*b* of the shield portion 100*a* of FIG. 1A in order to form a coupling joint 160.

Thereby, the user may grip the eyelash protector makeup accessory 100*c* via the curved gripping element 140 and wield the shield portion 100*a* via the elongate shaft 130 and the coupling joint 160 which couples together the coupling structures 120*a*, 120*b* as the extend from the bottom side surface 110 to the coupling structure 150 of the elongate handle portion 100*b* and enables the user to position the shield portion 100*a* into a desired position relative the user's eye.

Figure 2A:
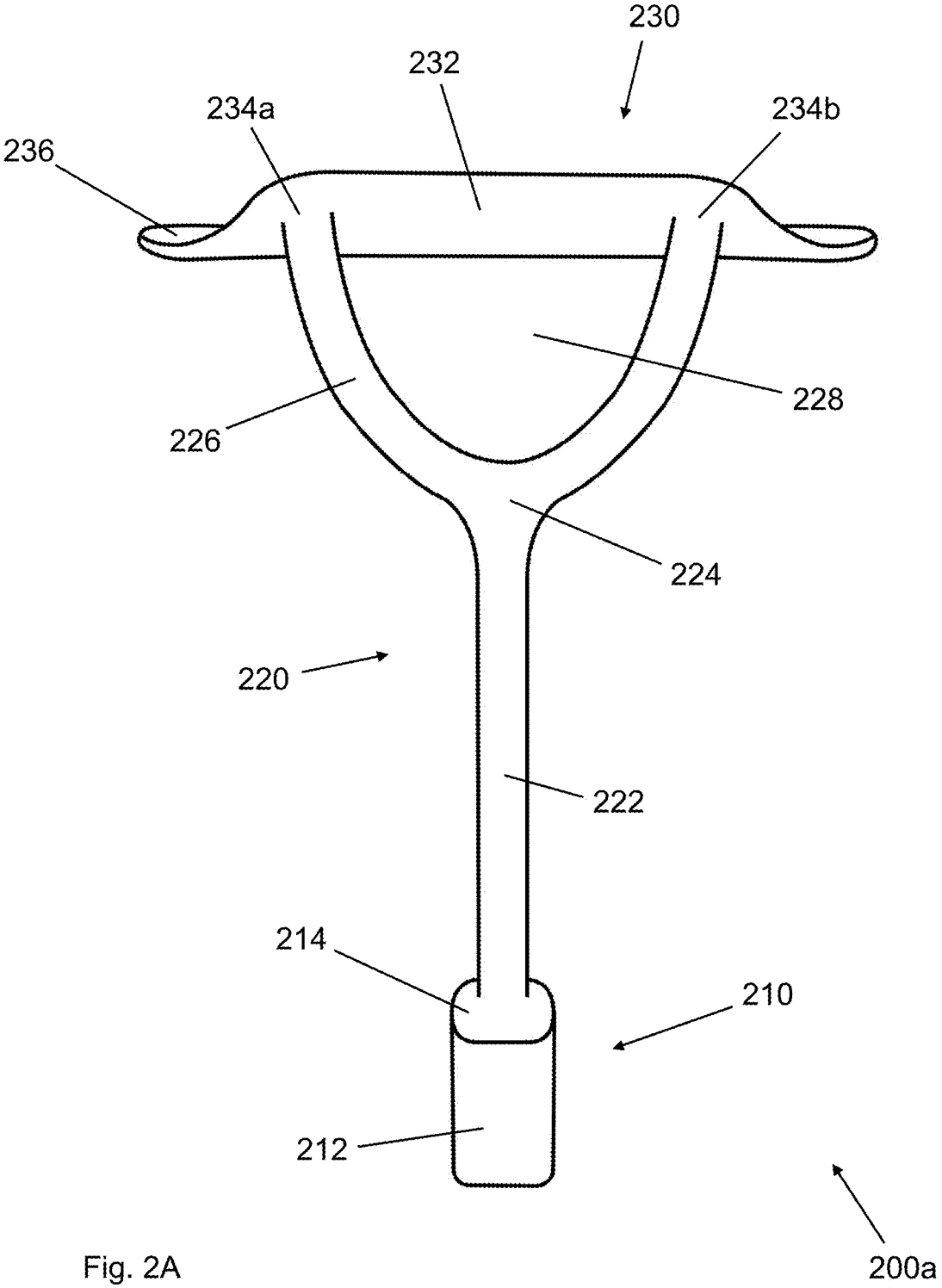
FIG. 2A illustrates a rear elevational view of an eyelash protector makeup accessory in a unitary configuration in accordance with some embodiments of the present invention.

As shown in FIG. 2A, a rear elevational view of an eyelash protector makeup accessory 200*a* in a unitary configuration is provided. The eyelash protector makeup accessory 200*a* may comprise a handle portion 210, a shaft portion 220 and a shield portion 230. The handle portion 210 may comprise a gripping element 212 for a user to grip and a flange portion 214 which may be utilized to couple to the proximal end of the shaft portion 220.

The shaft portion 220 may comprise an elongate shaft member 222, a coupling joint 224, a concave up member 226 and an aperture 228. Specifically, the elongate shaft member 222 may coupled to the concave up member 226 via the coupling joint 224. The interior of the concave up member 226 may comprise the aperture 228. The aperture 228 may be defined by the adjoining of the concave up member 226 to the shield portion 230 as shown in FIG. 2A. The shaft portion 220 may collectively form a general wishbone shape where the aperture 228 is advantageously positioned to align with a user's eye in order to allow the user to see as they apply makeup above the shield portion 230 of the eyelash protector makeup accessory 200*a*.

The shield portion 230 may comprise a bottom side surface 232, a pair of reinforced coupling joints 234*a*, 234*b*, and a top side surface 236. The bottom side surface 232 is arranged opposite that of the top side surface 236 such that the top side surface 236 may be utilized for collecting loose makeup that becomes disposed thereupon by acting as the physical buffer barrier between the application of makeup there above and the user's eyes and eyelashes there below. The bottom side surface 232 may comprise the reinforced coupling joints 234*a*, 234*b* which are structurally of a larger form factor than the remaining shield portion 230 in order to robustly couple the shield portion 230 to the shaft portion 220 without allowing structural compromise and breakage therebetween over an extended time period of use.

Figure 2B:
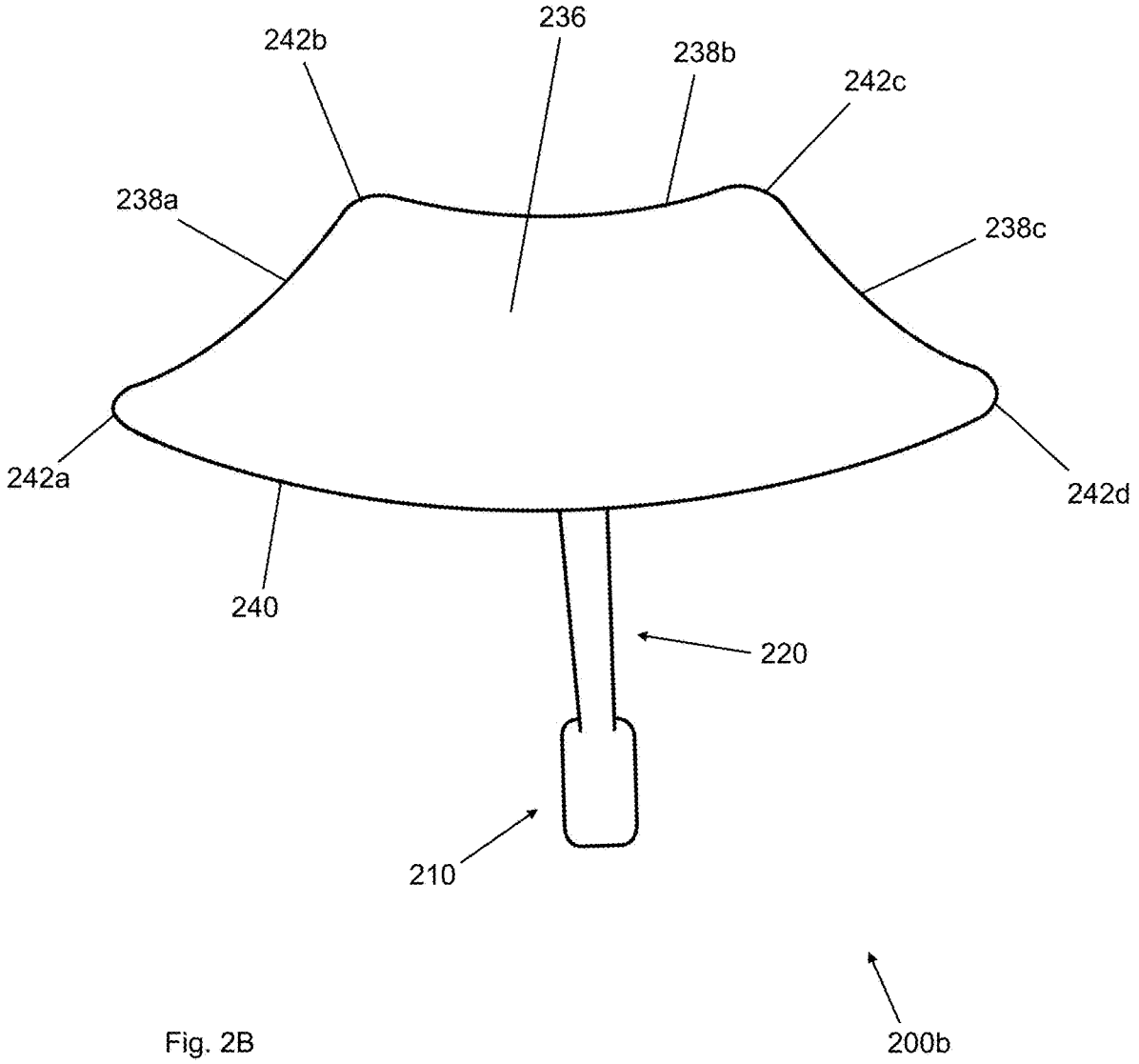
FIG. 2B illustrates a top perspective view of an eyelash protector makeup accessory in a unitary configuration in accordance with some embodiments of the present invention.

As shown in FIG. 2B, a top perspective view of an eyelash protector makeup accessory 200*b* in a unitary configuration is provided. The eyelash protector makeup accessory 200*b* may comprise the handle portion 210, the shaft portion 220 and the shield portion 230 as described with respect to FIG. 2A. However, the shield portion 230 may further comprise first, second and third concave side surfaces 238*a*-238*c* which are disposed around a convex side surface 240 that collectively define the top side surface 236 therebetween. Further, the side surfaces 238*a*-238*c*, 240 may each be successively separated by respective corner side surfaces 242*a*-242*d*.

It is clear from FIG. 2B that the top side surface 236 of the shield portion 230 may be structured to comprise a concave shape in order to provide an optimal collection structure for loose makeup that falls during application of eyeshadow above the eye. Consequently, the bottom side surface 232 of the shield portion 230 may be structured to comprise a corresponding convex shape. Moreover, each of the side surfaces 238*a*-238*c*, 240 may therefore comprise at least a slightly concave shape in order to effectuate the concave shape of the top side surface 236.

Figure 2C:
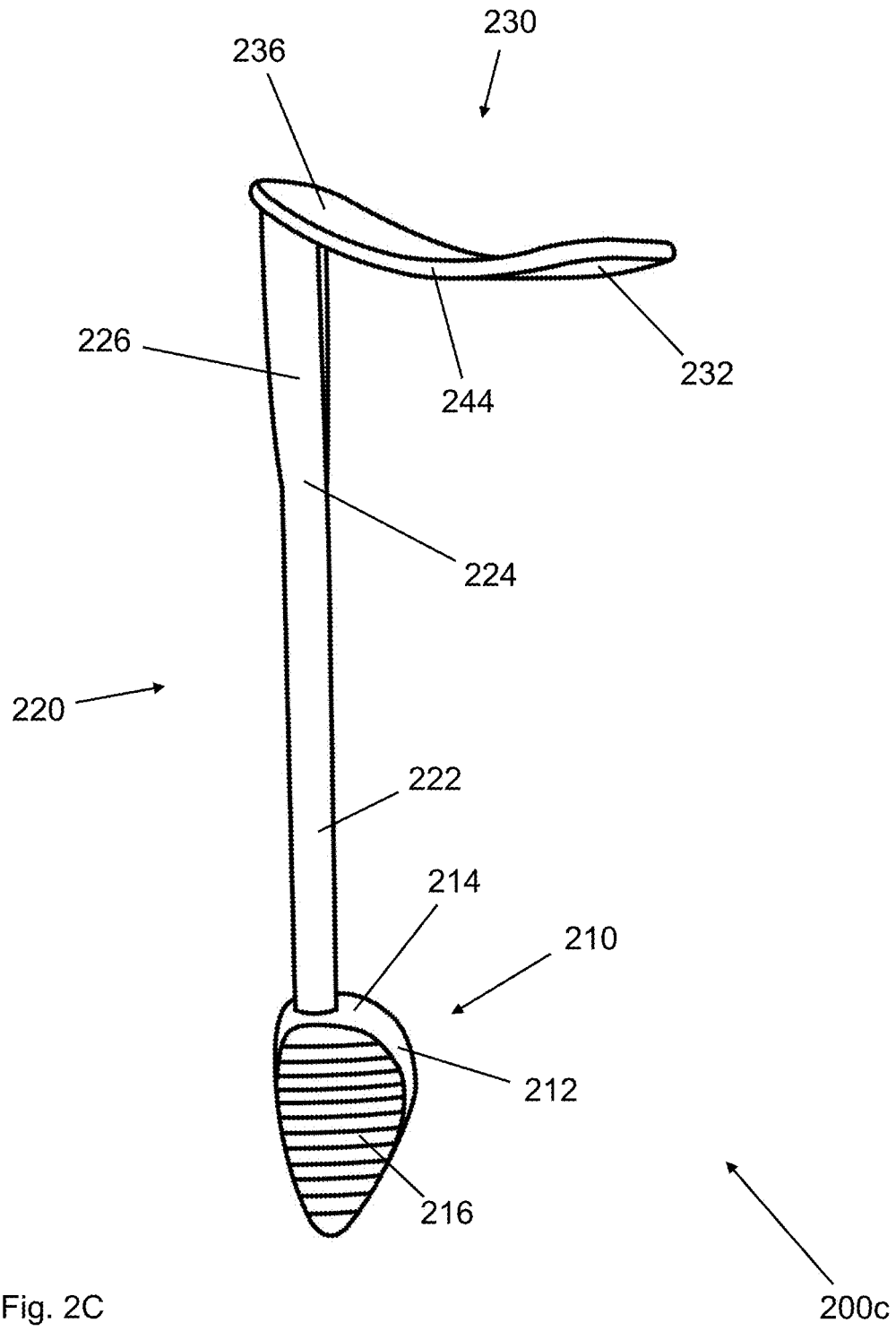
FIG. 2C illustrates a side elevational view of an eyelash protector makeup accessory in a unitary configuration in accordance with some embodiments of the present invention.

As shown in FIG. 2C, a side elevational view of an eyelash protector makeup accessory 200*c* in a unitary configuration is provided. The eyelash protector makeup accessory 200*c* may compromise the handle portion 210, the shaft portion 220 and the shield portion 230 as described with respect to FIG. 2A. However, the handle portion 210 may further comprise the curved gripping element 212 and the top flange portion 214 that are flanked on either side by a pair of gripping structures 216 which may be formed as a plurality of horizontal ridges separated successively by a respective plurality of troughs in order to form a periodic gripping structure 216 that allows the user to more easily grasp the handle portion 210 and thereby more easily maneuver the eyelash protector makeup accessory more effectively. Such a design optimizes the user-friendly functionality of the accessory while also advantageously reducing the likelihood of user injury caused by a lost grip. Additionally, the shield portion 230 is illustrated as having a concave inflection point 244 that defines the concave nature of the shield portion 230 for collecting loose makeup thereupon.

Each of the side surfaces 232, 236, 238*a*-238*c*, 240 may comprise a radius of curvature value that may be the same or different from one another and may be arranged in the same or different cross-sectional planes. The side surfaces 232, 236, 238*a*-238*c*, 240 of the eyelash protector makeup accessory, each featuring their own radius of curvature, offer tailored accommodation to various eye shapes and eyelash curvatures. It is advantageous for the front and rear side surfaces 232, 236, in particular, to possess radius of curvature values that approximate the average curvature of both natural and artificial eyelashes. By mirroring the typical eyelash curvature, these surfaces can provide a closer and more precise fit over the eyelash line, reducing the risk of makeup spillage onto the lashes and ensuring a cleaner application of eye cosmetics.

The incorporation of curvature values that reflect common eyelash profiles enables the eyelash protector makeup accessory to cater to a broad demographic, ensuring wide applicability and user satisfaction. The advantage extends to both comfort and efficiency. For instance, a well-fitted shield portion 230 will feel more natural over the eyelid, improving the user's experience, while also maximizing the protective function, which is the primary objective of the accessory. This attention to anatomical detail enhances the eyelash protector makeup accessory's ergonomics, leading to a more intuitive and less obstructive presence during makeup application.

Figure 3A:
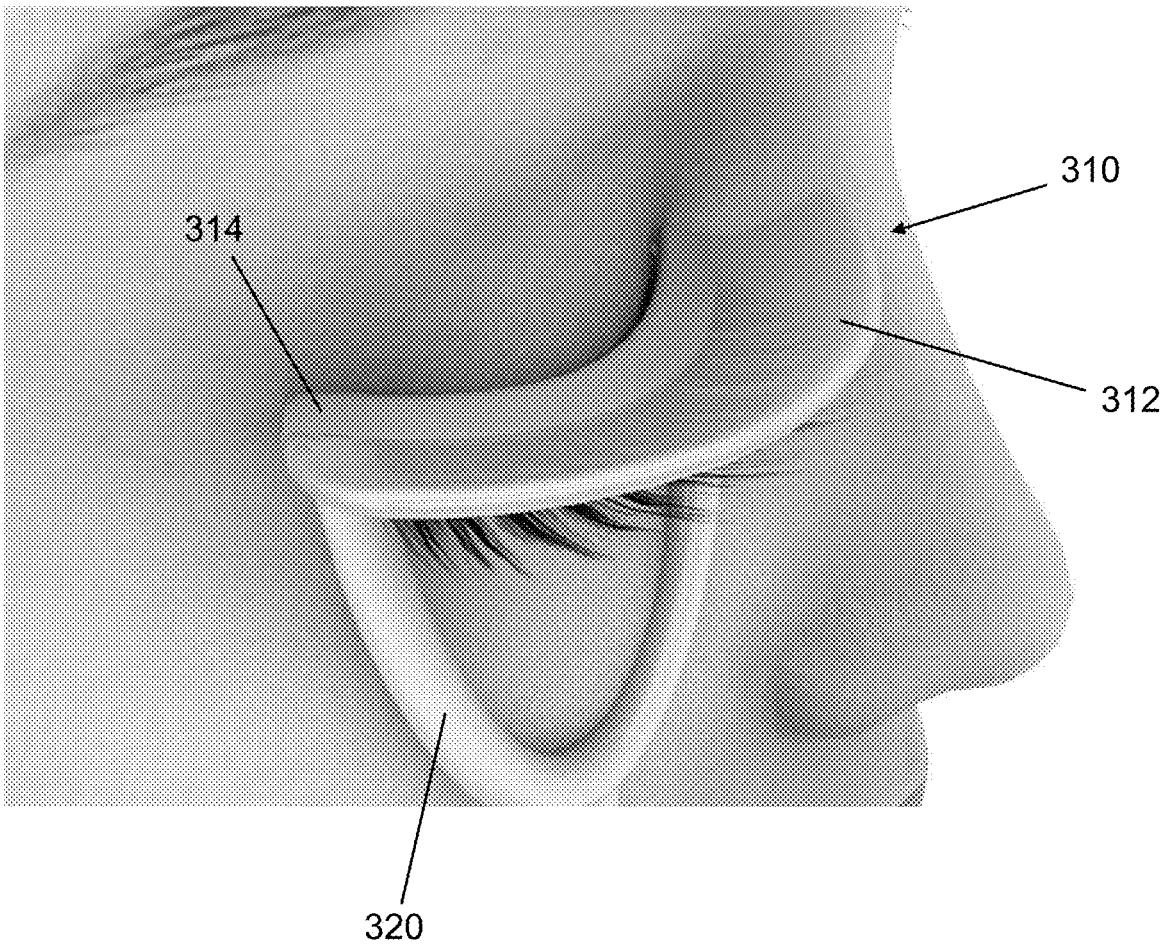
FIG. 3A illustrates a top perspective view of an eyelash protector makeup accessory in a unitary configuration applied to an eyelid of a user in accordance with some embodiments of the present invention.

As shown in FIG. 3A, a top perspective view of an eyelash protector makeup accessory 300*a* in a unitary configuration applied to an eyelid of a user is provided. The eyelash protector makeup accessory 300*a* may comprise a shield portion 310 having a distal collection portion 312 and a proximal seal portion 314. The distal collection portion 312 may comprise a slight concave U-shape in order to more effectively collect loose makeup therein. Further, the proximal seal portion 314 may comprise a continuation of the slight concave U-shape of the distal collection portion 312. The seal portion 314 may be disposed directly adjacent a user's eyelid right above their eyelashes in order to allow a user to apply eye shadow thereto. In some embodiments, the seal portion 314 may be structurally separate from and disposed over the collection portion 312 and the remainder of the eyelash protector makeup accessory 300*a*.

For the distal collection portion 312 of the eyelash protector makeup accessory 300*a*, incorporating a material layer atop this section that optimizes collecting loose makeup, yet resists being easily disturbed by slight breezes and the like, is crucial for enhancing the device's efficacy and user convenience. A silicone-based coating offers an ideal solution, given its inherent tackiness and resistance to environmental factors. This silicone layer can gently grip loose makeup particles, preventing them from scattering while still allowing for easy removal with water or a mild cleaning solution. Silicone is highly durable, non-reactive, and hypoallergenic, making it suitable for use in close proximity to the sensitive eye area. Furthermore, its water-repellent nature ensures that it does not absorb makeup or moisture, facilitating a simple cleanup process. By employing a silicone coating on the collection portion 312, the device not only improves its functionality in securely collecting excess makeup but also ensures the process is hygienic and user-friendly, aligning with the needs of consumers for efficient and straightforward maintenance.

For the proximal seal portion 314, materials that could be used to comfortably conform to the eyelid while being gentle on the skin and effective in collecting loose makeup include medical-grade silicone or a soft thermoplastic elastomer (TPE). These materials are known for their flexibility and softness, allowing the seal portion to comfortably fit the unique contours of each user's eyelid. Medical-grade silicone, in particular, is biocompatible, ensuring that it is safe for direct skin contact without causing irritation or allergic reactions. TPE, on the other hand, can provide a softer contact point, reducing the risk of discomfort during use. Both materials are excellent at forming a gentle yet effective barrier against loose makeup, ensuring that it is collected without spreading to undesired areas. Their easy-to-clean nature also ensures that users can maintain hygiene with minimal effort, enhancing the overall user experience.

In contemplating the comprehensive design of the eyelash protector makeup accessory 300*a*, there exists the possibility of constructing the entire accessory 300*a* from silicone-based materials or similar flexible, soft materials. The primary advantage of such a design would be the ease of fabrication, potentially lowering manufacturing costs due to the simplicity of molding and the reduced number of assembly steps while still providing the previously described benefits, e.g. gently gripping loose makeup particles, preventing them from scattering, still allowing for easy removal with water or a mild cleaning solution, biocompatibility of the material etc. This material choice would also enhance user comfort, as the soft, pliable nature of silicone would be gentle against the skin and reduce the risk of accidental injury.

Figure 3B:
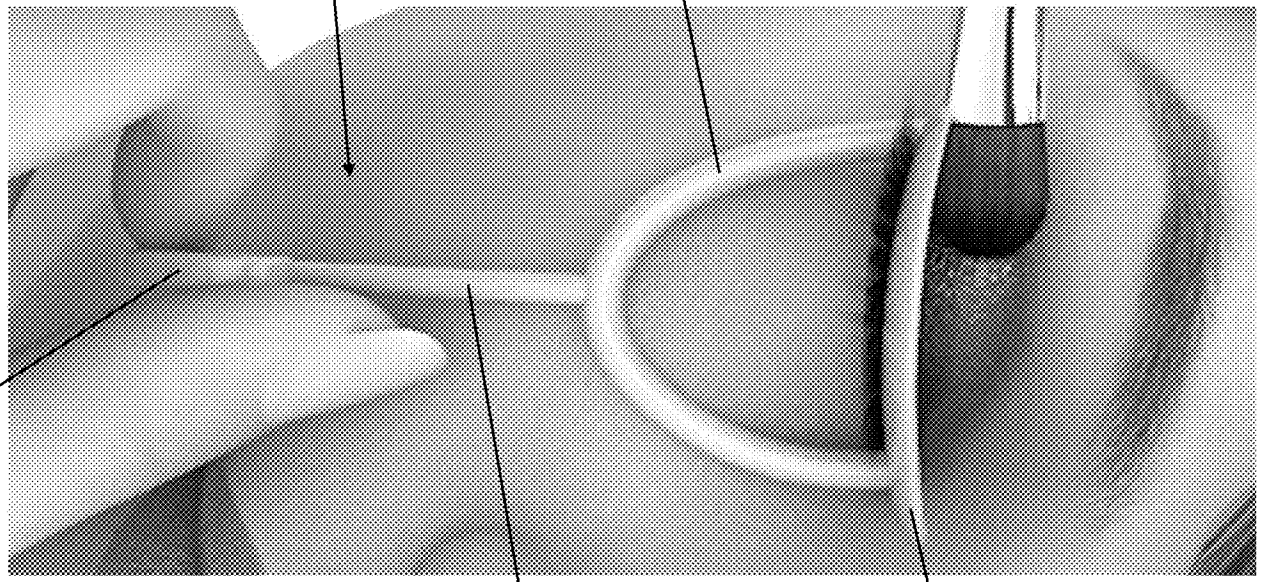
FIG. 3B illustrates a front elevational view of an eyelash protector makeup accessory in a unitary configuration applied to an eyelid of a user in order to protect the user's eye and eyelashes while applying makeup in accordance with some embodiments of the present invention.

As shown in FIG. 3B, a front elevational view of an eyelash protector makeup accessory 300*b* in a unitary configuration applied to an eyelid of a user in order to protect the user's eye and eyelashes while applying makeup is provided. The eyelash protector makeup accessory 300*b* may comprise the shield portion 310, the shaft portion 320 and the handle portion 330. The handle portion 330 may comprise an elongate handle member 332 which couples the shaft portion 320 to a terminal gripping element 334 which is illustrated being gripped by a user in order to position the eyelash protector makeup accessory 300*b* over the user's eyelashes in order to shield the user's eyes and eyelashes from loose makeup falling during application of the eye shadow to the user's eyelid.

Figure 4:
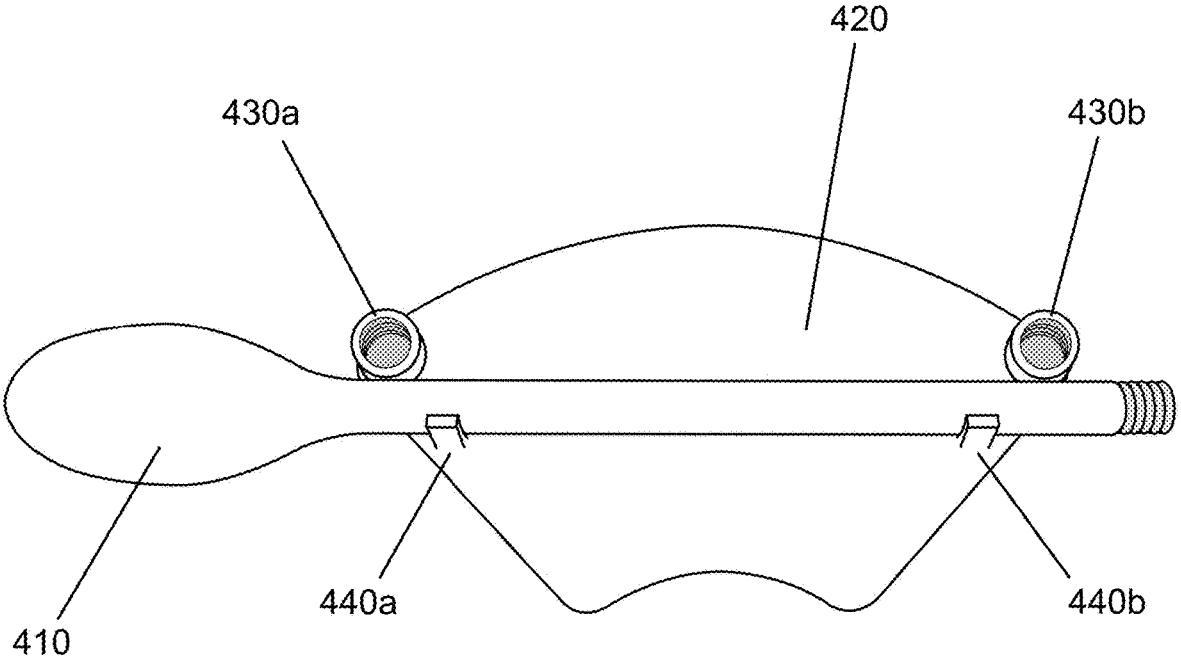
FIG. 4 illustrates a bottom overhead view of an eyelash protector makeup accessory with a shaft and handle portion coupled to a shield portion in a stowed configuration in accordance with some embodiments of the present invention.

As shown in FIG. 4, a bottom overhead view of an eyelash protector makeup accessory 400 with a shaft and handle portion 410 coupled to a shield portion 420 in a stowed configuration is provided. The stowed configuration of the eyelash protector makeup accessory 400 involves the shaft and handle portion 410 being coupled between a first and second coupling structures 430*a*, 430*b* and first and second retaining structures 440*a*, 440*b*. Specifically, the shaft of the portion 410 may be disposed between a cylindrical outer body wall of the first coupling structure 430*a* and the first retaining structures 440*a* at a first area of the shaft. Further, the shaft of the portion 410 may be disposed between a cylindrical outer body wall of the second coupling structure 430*b* and the second retaining structures 440*b* at a second area of the shaft that is disposed at an opposite side of the shaft relative the first area.

In the stowed configuration of the eyelash protector makeup accessory 400, various means can be employed to securely couple the shaft and handle portion 410 between the first and second coupling structures 430*a*, 430*b* and the corresponding first and second retaining structures 440*a*, 440*b*. One method could involve a snap-fit mechanism, where the shaft features protrusions or ridges that correspond to recesses or grooves within the coupling structures 430*a*, 430*b* or retaining structures 440*a*, 440*b*. This design would allow for an easy and secure attachment through a simple press-fit action, providing a quick and user-friendly means of transitioning the device to and from its stowed configuration. Alternatively, a magnetic coupling could be used, with magnets embedded within the shaft and coupling structures 430*a*, 430*b* or retaining structures 440*a*, 440*b* to ensure a secure hold without the need for mechanical fastening. Another possibility is a twist-lock mechanism, where the user aligns the shaft with the coupling structures 430*a*, 430*b* or retaining structures 440*a*, 440*b* and rotates it to lock it into place. This would provide a stable connection while still allowing for relatively easy disassembly. Each of these methods offers a reliable way to couple the shaft to the shield portion 420, ensuring the accessory 400 remains compact and protected when not in use.

In some embodiments of FIGS. 1A-4, an eyelash protector makeup accessory is provided which comprises a shield portion having a first side surface opposite a second side surface and a third side surface opposite a fourth side surface, wherein: a first coupling structure is disposed adjacent a first peripheral edge of the first side surface, the first side surface comprises a first convex shape having a first radius of curvature value, and the third side surface comprises a first concave shape having a second radius of curvature value; and an elongate handle portion having an elongate shaft, wherein: the elongate shaft comprises a gripping element disposed at a proximal end thereof and a second coupling structure disposed at a distal end thereof, the second coupling structure is shaped in a complimentary manner relative the first coupling structure, and the second coupling structure removably engages the first coupling structure.

In some embodiments of FIGS. 1A-4, the shield portion comprises a plurality of corner side surfaces disposed between the first side surface and the second side surface, the fourth side surface comprises a second convex shape having a third radius of curvature value, the first concave shape is disposed between first and second corner side surfaces of the plurality of corner side surfaces, and the second convex shape is disposed between third and fourth corner side surfaces of the plurality of corner side surfaces.

In some embodiments of FIGS. 1A-4, a fifth side surface is disposed between the first and third corner side surfaces of the plurality of corner side surfaces, a sixth side surface is disposed between the second and fourth corner side surfaces of the plurality of corner side surfaces, the fifth and sixth side surfaces are each disposed between the third and fourth side surfaces, the fifth and sixth side surfaces are each disposed in a common plane relative the third and fourth side surfaces, and the fifth and sixth side surfaces are not oriented parallel one another.

In some embodiments of FIGS. 1A-4, the accessory further comprises a fifth side surface and a sixth side surface of the shield portion, wherein the the fifth and sixth side surfaces each comprise the first convex shape having the first radius of curvature value, the fifth and sixth side surfaces each terminate into of a plurality of corner side surfaces, the first coupling structure is disposed adjacent a first corner side surface of the plurality of corner side surfaces, the second coupling structure is disposed adjacent the first corner side surface of the plurality of corner side surfaces, and the first coupling structure is disposed adjacent the third side surface and the fifth or sixth side surface.

In some embodiments of FIGS. 1A-4, the second coupling structure terminates at a distal terminal end, the gripping element terminates at a proximal terminal end, and when the first coupling structure engages with the second coupling structure, the elongate handle portion is oriented orthogonal to the shield portion.

In some embodiments of FIGS. 1A-4, an eyelash protector makeup accessory is provided which comprises a shield portion having a first side surface opposite a second side surface and a third side surface opposite a fourth side surface, wherein: a first coupling joint is disposed adjacent a first peripheral edge of the first side surface, the first side surface comprises a first convex shape having a first radius of curvature value, and the third side surface comprises a first concave shape having a second radius of curvature value; and an elongate handle portion having an elongate shaft, wherein: the elongate shaft comprises a gripping element disposed at a proximal end thereof and a second coupling joint disposed at a distal end thereof, the second coupling joint couples the elongate shaft to a concave up member, the concave up member is coupled to the first peripheral edge of the first side surface of the shield portion via the first coupling joint, and an aperture is defined by the concave up member and the shield portion.

In some embodiments of FIGS. 1A-4, an eyelash protector makeup accessory is provided which comprises a shield portion having a first side surface opposite a second side surface and a third side surface opposite a fourth side surface, wherein: a first coupling structure is disposed adjacent a first peripheral edge of the first side surface, the first coupling structure is disposed adjacent a first corner side surface, the first side surface comprises a first convex shape having a first radius of curvature value, and the third side surface comprises a first concave shape having a second radius of curvature value; and an elongate handle portion having an elongate shaft, wherein: the elongate shaft comprises a gripping element disposed at a proximal end thereof and a second coupling structure disposed at a distal end thereof, the second coupling structure is shaped in a complimentary manner relative the first coupling structure, the second coupling structure removably engages with the first coupling structure, and when the first coupling structure engages with the second coupling structure, the elongate handle portion is oriented orthogonal to the shield portion and the second coupling structure is disposed adjacent the first corner side surface.

The specification and drawings are to be regarded in an illustrative rather than a restrictive sense. However, it will be evident that various modifications and changes may be made thereunto without departing from the broader spirit and scope of the invention as set forth in the claims. Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

All features disclosed in the specification, claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise.

Throughout this disclosure, the phrase 'modularly coupled' and similar terms and phrases are intended to convey that any element of a given class of elements may be coupled to another given element and vice versa with equal effect. For example, any extension cord of a plurality of extension cords may be modularly coupled to another extension cord and vice versa with equal effect. Further, throughout this disclosure, the phrase 'removably coupled' and similar terms and phrases are intended to convey that a given element may be iteratively coupled to and removed from another given element as desired. For example, a male plug of a first extension cord may be removably coupled to a female plug of a second extension cord as desired.

The use of the terms "a," "an," "the," and similar referents in the context of describing the disclosed embodiments (especially in the context of the following claims) are to be construed to cover both the singular and the plural, unless otherwise indicated or clearly contradicted by context. The terms "comprising," "having," "including," and "containing" are to be construed as open-ended terms (i.e., meaning "including, but not limited to,") unless otherwise noted. The term "coupled" or "connected," where unmodified and referring to physical connections, is to be construed as partly or wholly contained within, attached to, or joined together, even if there is something intervening. Recitation of ranges of values are merely intended to serve as a shorthand method of referring individually to each separate value falling within the range, unless otherwise indicated and each separate value is incorporated into the specification as if it were individually recited. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal.

Conjunctive language, such as phrases of the form "at least one of A, B, and C," or "at least one of A, B and C," is understood with the context as used in general to present that an item, term, etc., may be either A or B or C, or any nonempty subset of the set of A and B and C, unless specifically stated otherwise or otherwise clearly contradicted by context. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, the term "plurality" indicates a state of being plural (e.g., "a plurality of items" indicates multiple items). The number of items in a plurality is at least two, but can be more when so indicated either explicitly or by context.

The use of any examples, or exemplary language (e.g., "such as") provided, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described. Accordingly, the scope of the present disclosure includes all modifications and equivalents of the subject matter recited in the claims appended hereto as permitted by applicable law. Moreover, although above-described elements may be described in the context of certain embodiments of the specification, unless stated otherwise or otherwise clear from context, these elements are not mutually exclusive to only those embodiments in which they are described; any combination of the above-described elements in all possible variations thereof is encompassed by the scope of the present disclosure unless otherwise indicated or otherwise clearly contradicted by context.

All references, including publications, patent applications, and patents, cited are hereby incorporated by reference to the same extent as if each reference were individually and specifically indicated to be incorporated by reference and were set forth in its entirety.

The invention claimed is:

1. An eyelash protector makeup accessory, comprising:

a shield portion having a first side surface opposite a second side surface and a third side surface opposite a fourth side surface, wherein:

a first coupling structure is disposed adjacent a first peripheral edge of the first side surface, the first side surface comprises a first convex shape having a first radius of curvature value, and the third side surface comprises a first concave shape having a second radius of curvature value; and further comprising a fifth side surface and a sixth side surface of the shield portion, wherein the fifth and sixth side surfaces each comprise the first convex shape having the first radius of curvature value, and an elongate handle portion having an elongate shaft, wherein:

the elongate shaft comprises a gripping element disposed at a proximal end thereof and a second coupling structure disposed at a distal end thereof, the second coupling structure is shaped in a complimentary manner relative the first coupling structure, and the second coupling structure removably engages the first coupling structure.

2. The eyelash protector makeup accessory of claim 1, wherein the shield portion comprises a plurality of corner side surfaces disposed between the first side surface and the second side surface.

3. The eyelash protector makeup accessory of claim 2, wherein the fourth side surface comprises a second convex shape having a third radius of curvature value.

4. The eyelash protector makeup accessory of claim 3, wherein the first concave shape is disposed between first and second corner side surfaces of the plurality of corner side surfaces.

5. The eyelash protector makeup accessory of claim 4, wherein the second convex shape is disposed between third and fourth corner side surfaces of the plurality of corner side surfaces.

6. The eyelash protector makeup accessory of claim 5, wherein a fifth side surface is disposed between the first and third corner side surfaces of the plurality of corner side surfaces.

7. The eyelash protector makeup accessory of claim 6, wherein a sixth side surface is disposed between the second and fourth corner side surfaces of the plurality of corner side surfaces.

8. The eyelash protector makeup accessory of claim 7, wherein the fifth and sixth side surfaces are each disposed between the third and fourth side surfaces.

9. The eyelash protector makeup accessory of claim 7, wherein the fifth and sixth side surfaces are each disposed in a common plane relative the third and fourth side surfaces.

10. The eyelash protector makeup accessory of claim 7, wherein the fifth and sixth side surfaces are not oriented parallel one another.

11. The eyelash protector makeup accessory of claim 1, wherein the fifth and sixth side surfaces each terminate into of a plurality of corner side surfaces.

12. The eyelash protector makeup accessory of claim 11, wherein the first coupling structure is disposed adjacent a first corner side surface of the plurality of corner side surfaces.

13. The eyelash protector makeup accessory of claim 12, wherein the second coupling structure is disposed adjacent the first corner side surface of the plurality of corner side surfaces.

14. The eyelash protector makeup accessory of claim 1, wherein the first coupling structure is disposed adjacent the fourth side surface and the fifth or sixth side surface.

15. The eyelash protector makeup accessory of claim 1, wherein the second coupling structure terminates at a distal terminal end.

16. The eyelash protector makeup accessory of claim 1, wherein the gripping element terminates at a proximal terminal end.

17. The eyelash protector makeup accessory of claim 1, wherein, when the first coupling structure engages with the second coupling structure, the elongate handle portion is oriented orthogonal to the shield portion.

18. An eyelash protector makeup accessory, comprising:

a shield portion having a first side surface opposite a second side surface and a third side surface opposite a fourth side surface, wherein, a first coupling structure is disposed adjacent a first peripheral edge of the first side surface, the first coupling structure is disposed adjacent a first corner side surface, the first side surface comprises a first convex shape having a first radius of curvature value, and the third side surface comprises a first concave shape having a second radius of curvature value; and further comprising a fifth side surface and a sixth side surface of the shield portion, wherein the fifth and sixth side surfaces each comprise the first convex shape having the first radius of curvature value, and an elongate handle portion having an elongate shaft, wherein:

the elongate shaft comprises a gripping element disposed at a proximal end thereof and a second coupling structure disposed at a distal end thereof, the second coupling structure is shaped in a complimentary manner relative the first coupling structure, the second coupling structure removably engages with the first coupling structure, and when the first coupling structure engages with the second coupling structure, the elongate handle portion is oriented orthogonal to the shield portion and the second coupling structure is disposed adjacent the first corner side surface.

* * * * *